US011414630B2

(12) United States Patent
Burgess et al.

(10) Patent No.: US 11,414,630 B2
(45) Date of Patent: Aug. 16, 2022

(54) PERFUME PARTICLES FOR LAUNDRY COMPOSITION

(71) Applicant: Conopco, Inc., Englewood Cliffs, NJ (US)

(72) Inventors: Karl Burgess, Wirral (GB); Shaun Charles Walsh, Cheadle (GB)

(73) Assignee: Conopco, Inc., Englewood Cliffs, NJ (US)

( * ) Notice: Subject to any disclaimer, the term of this patent is extended or adjusted under 35 U.S.C. 154(b) by 228 days.

(21) Appl. No.: 16/634,714

(22) PCT Filed: Jul. 24, 2018

(86) PCT No.: PCT/EP2018/070065
§ 371 (c)(1),
(2) Date: Jan. 28, 2020

(87) PCT Pub. No.: WO2019/025244
PCT Pub. Date: Feb. 7, 2019

(65) Prior Publication Data

US 2020/0199499 A1 Jun. 25, 2020

(30) Foreign Application Priority Data

Aug. 2, 2017 (EP) ..... 17184414

(51) Int. Cl.

| | |
|---|---|
| ***C11D 3/37*** | (2006.01) |
| ***C11D 3/50*** | (2006.01) |
| ***C11D 3/22*** | (2006.01) |
| ***C11D 17/00*** | (2006.01) |

(52) U.S. Cl.
CPC ..... *C11D 3/502* (2013.01); *C11D 3/221* (2013.01); *C11D 3/3707* (2013.01); *C11D 17/0039* (2013.01)

(58) Field of Classification Search
CPC . C11D 17/0047; C11D 17/0082; C11D 3/001; C11D 3/221; C11D 3/3707; C11D 3/505
See application file for complete search history.

(56) References Cited

U.S. PATENT DOCUMENTS

| | | | | |
|---|---|---|---|---|
| 6,025,319 | A | 2/2000 | Surutzidis et al. | |
| 7,871,976 | B1 * | 1/2011 | Aouad | C08L 71/02 512/2 |
| 2009/0042766 | A1 | 2/2009 | Mayer et al. | |
| 2009/0209661 | A1 | 8/2009 | Somerville Roberts et al. | |
| 2012/0165239 | A1 | 6/2012 | Dreja et al. | |

FOREIGN PATENT DOCUMENTS

| | | | | |
|---|---|---|---|---|
| JP | 55147597 | | 11/1980 | |
| WO | WO-2008009521 | A1 * | 1/2008 | C11D 3/3707 |
| WO | WO2008129028 | | 10/2008 | |
| WO | WO2016081006 | | 5/2016 | |
| WO | WO2016099852 | | 6/2016 | |
| WO | WO2017125235 | | 7/2017 | |

OTHER PUBLICATIONS

IPRP2 for PCTEP2018070065; dated Jul. 26, 2019.
Armstrong N A et al.; Drug Development and Industrial Pharmacy the Compressional Properties of Dextrose Mnohydrate and Anhydrous Dextrose of Varying Water Contents; Drug Development and Industrial Pharmacy; Jan. 1, 1986; pp. 1885-1901; XP000946602; vol. 12, No. 11-13.
Search Report and Written Opinion in PCTEP2018070065; dated Oct. 5, 2018.
Search Report and Written Opinion in PCTEP2018069880; dated Sep. 21, 2018.
Search Report and Written Opinion in EP17184420; dated Feb. 12, 2018.
Search Report and Written Opinion in EP17184412; dated Feb. 9, 2018.

* cited by examiner

*Primary Examiner* — John R Hardee
(74) *Attorney, Agent, or Firm* — Carter, DeLuca & Farrell LLP; George Likourezos

(57) ABSTRACT

A composition comprising a plurality of particles, wherein said particles comprise: 40 to 95 w.t. % polyethylene glycol, wherein the polyethylene glycol has a weight average molecular weight from 4000 to 12000; 0.1 to 50 w.t. % anhydrous saccharide comprising one to ten monosaccharide units; and 0.1 to 20 w.t. % perfume materials.

9 Claims, No Drawings

PERFUME PARTICLES FOR LAUNDRY COMPOSITION

FIELD OF THE INVENTION

Perfume particles for laundry.

BACKGROUND OF THE INVENTION

Fragrance is an important aspect of the laundry process. Consumers often associate fragrance with cleanliness or simply enjoy the smell; accordingly many laundry products comprise perfumes. However, the desired quantity of perfume varies from consumer to consumer. Consequently perfume particles have been developed to allow consumers to tailor their perfume experience based on their person preferences.

WO 2016/099852 discloses a composition of a plurality of homogeneously structured particles. The particles include polyethylene glycol, perfume, and starch granules and each has a mass between about 0.95 mg and about 5 grams.

A technical problem has been identified with the stability of particles comprising starch. The particles comprising starch, particularly those in open containers, undergo a change in their composition or structure over time. This change is particularly evident in particles comprising colourants, wherein the particles exhibit uneven colouration over time. There is a need to improve the stability of laundry perfume particles.

SUMMARY OF THE INVENTION

A composition comprising a plurality of particles, wherein said particles comprise: 40 to 95 w.t. % polyethylene glycol, wherein the polyethylene glycol has a weight average molecular weight from 4000 to 12000; 0.1 to 50 w.t. % saccharide comprising one to ten monosaccharide units; and 0.1 to 30 w.t. % perfume materials, wherein the saccharide is anhydrous.

The invention is also concerned with use of the particles to impart fragrance to laundered fabrics.

DETAILED DESCRIPTION OF THE INVENTION

These and other aspects, features and advantages will become apparent to those of ordinary skill in the art from a reading of the following detailed description and the appended claims. For the avoidance of doubt, any feature of one aspect of the present invention may be utilised in any other aspect of the invention. The word "comprising" is intended to mean "including" but not necessarily "consisting of" or "composed of." In other words, the listed steps or options need not be exhaustive. It is noted that the examples given in the description below are intended to clarify the invention and are not intended to limit the invention to those examples per se. Similarly, all percentages are weight/weight percentages unless otherwise indicated. Except in the operating and comparative examples, or where otherwise explicitly indicated, all numbers in this description indicating amounts of material or conditions of reaction, physical properties of materials and/or use are to be understood as modified by the word "about". Numerical ranges expressed in the format "from x to y" are understood to include x and y. When for a specific feature multiple preferred ranges are described in the format "from x to y", it is understood that all ranges combining the different endpoints are also contemplated.

Polyethylene Glycol (PEG)

Polyethylene Glycol (PEG) comes in various weight average molecular weights. A suitable weight average molecular weight of PEG for the purposes of the present invention includes from 4,000 to 12,000, preferably 5,000 to 11,000, more preferably 6,000 to 10,000 and most preferably 7,000 to 9,000. Non-limiting examples of suitable PEG is are: Polyglycol 8000 ex Clariant and Pluriol 8000 ex BASF.

The particles of the present invention comprise 40 to 95 w.t. % PEG, preferably 50 to 85 w.t. % PEG, more preferably 75 w.t. % PEG and most preferably 60 to 70 w.t. % PEG.

The PEG can have a PEG perfume load level. The PEG perfume load level is the ratio of the mass of perfume in the PEG to the mass of PEG alone. To promote release of perfume, it can be desirable for the PEG perfume load level to be greater than the glucose perfume load level. The PEG perfume load level can be measured and compared to the glucose load level by 1) heating a sample of the particles according to the present invention above their melting point, 2) centrifuging the sample to separate the molten PEG phase from the dextrose, 3) removing an equal weight portion of both phases, 4) diluting each phase with suitable level of methanol to enable measuring of the relative perfume level of each material via standard gas chromatography and mass spectrometer techniques.

Saccharide Comprising One to Ten Monosaccharide Units

Saccharides are molecular compounds comprising carbon, hydrogen and oxygen. The particles of the present invention comprise a saccharide comprising one to ten monosaccharide units and mixtures thereof. In other words the particles of the present invention comprise either a monosaccharide or an oligosaccharide or mixtures thereof. An oligosaccharide is a short saccharide polymer, typically considered in the art to comprise between two and ten monosaccharides units.

The particles of the present invention comprise a saccharide, it is preferred that the saccharide comprises 1 to 5 monosaccharide units, more preferably 1 to 4 monosaccharide units, most preferably the saccharide comprises monosaccharides, disaccharides or mixtures thereof.

Disaccharides are the product of a reaction between two monosaccharides. They may be formed from two identical monosaccharides or two different monosaccharides. Examples of disaccharides include: sucrose, maltose, lactose.

Monosaccharides are simple sugar units having the general formula $(CH_2O)_n$. Commonly n is 3, 5 or 6. According, monosaccharides can be classified by the number n, for example: trioses (e.g. glyceraldehyde), pentoses (e.g. ribose) and hexoses (e.g. fructose, glucose and galactose). Some monosaccharides may be substituted with additional functional groups, e.g. Glucosamine, others may have undergone deoxgenation and lost an oxygen atom e.g. deoxyribose. Therefore, the general chemical formulae can vary slightly depending on the monosaccharide.

Preferred monosaccharides in the present invention are hexose molecules (n=6). Hexose molecules all have the same molecular formula, however have a different structural formula, i.e. are structural isomers. It is preferred that the hexose comprises a 6-membered ring, opposed to a 5 membered ring. Glucose and galactose have 6-membered rings.

In a preferred embodiment the hexose monosaccharide is glucose. Glucose is a chiral molecule, having a mixture of D and L stereo isomers. Particularly preferably, the glucose of the present invention is the D isomer of glucose, also known as dextrose. Dextrose exists in two forms; dextrose monohydrate which contains one molecule of water and anhydrous dextrose which contains no water. Preferably, the dextrose of the present invention is anhydrous dextrose.

The saccharide material in anhydrous, i.e. free of any water. For example, dextrose monohydrate contains one molecule of water whereas anhydrous dextrose contains none.

The particles of the present invention comprises 0.1 to 50 w.t. % Saccharide comprising one to ten monosaccharide units, preferably 10 to 40 w.t. % Saccharide comprising one to ten monosaccharide units, most preferably 20 to 38 w.t. % Saccharide comprising one to ten monosaccharide units.

The particles of the present invention comprise 0.1 to 50 w.t. % of the herein described saccharides, preferably 4 to 50 w.t. % of the saccharides, preferably 5 to 45 w.t. %, preferably 10 to 40 w.t. % of the saccharides, most preferably 20 to 38 w.t. % of the saccharides.

Non-limiting examples of suitable saccharides for the present invention are: C*Dex ex Cargill, Treha ex Cargill, Anhydrous Dextrose ex Foodchem.

Due to the sweetness that some saccharide materials provide to a composition, it may be preferable to include bitter material such as Bitrex ex Johnson Matthey Fine Chemicals.

Perfume

The particles of the present invention comprises 0.1 to 30 w.t. % perfume materials, i.e. free perfume and/or perfume microcapsules. As is known in the art, free perfumes and perfume microcapsules provide the consumer with perfume hits at different points during the wash cycle. It is particularly preferred that the particles of the present invention comprise a combination of both free perfume and perfume microcapsules.

Preferably the particles of the present invention comprises 0.5 to 20 w.t. % perfume materials, more preferably 1 to 15 w.t. % perfume materials, most preferably 2 to 10 w.t. % perfume materials.

Useful perfume components may include materials of both natural and synthetic origin. They include single compounds and mixtures. Specific examples of such components may be found in the current literature, e.g., in Fenaroli's Handbook of Flavor Ingredients, 1975, CRC Press; Synthetic Food Adjuncts, 1947 by M. B. Jacobs, edited by Van Nostrand; or Perfume and Flavor Chemicals by S. Arctander 1969, Montclair, N.J. (USA). These substances are well known to the person skilled in the art of perfuming, flavouring, and/or aromatizing consumer products.

Free Perfumes:

The particles of the present invention preferably comprises 0.1 to 15 w.t. % free perfume, more preferably 0.5 to 8 w.t. % free perfume.

Particularly preferred perfume components are blooming perfume components and substantive perfume components. Blooming perfume components are defined by a boiling point less than 250° C. and a Log P or greater than 2.5. Substantive perfume components are defined by a boiling point greater than 250° C. and a Log P greater than 2.5. Boiling point is measured at standard pressure (760 mm Hg). Preferably, a perfume composition will comprise a mixture of blooming and substantive perfume components. The perfume composition may comprise other perfume components.

It is commonplace for a plurality of perfume components to be present in a free oil perfume composition. In the compositions for use in the present invention it is envisaged that there will be three or more, preferably four or more, more preferably five or more, most preferably six or more different perfume components. An upper limit of 300 perfume components may be applied.

Perfume Microcapsules:

The particles of the present invention preferably comprises 0.1 to 15 w.t. % perfume microcapsules, more preferably 0.5 to 8 w.t. % perfume microcapsules. The weight of microcapsules is of the material as supplied.

When perfume components are encapsulated, suitable encapsulating materials, may comprise, but are not limited to; aminoplasts, proteins, polyurethanes, polyacrylates, polymethacrylates, polysaccharides, polyamides, polyolefins, gums, silicones, lipids, modified cellulose, polyphosphate, polystyrene, polyesters or combinations thereof. Particularly preferred materials are aminoplast microcapsules, such as melamine formaldehyde or urea formaldehyde microcapsules.

Perfume microcapsules of the present invention can be friable microcapsules and/or moisture activated microcapsules. By friable, it is meant that the perfume microcapsule will rupture when a force is exerted. By moisture activated, it is meant that the perfume is released in the presence of water. The particles of the present invention preferably comprises friable microcapsules. Moisture activated microcapsules may additionally be present. Examples of a microcapsules which can be friable include aminoplast microcapsules.

Perfume components contained in a microcapsule may comprise odiferous materials and/or pro-fragrance materials.

Particularly preferred perfume components contained in a microcapsule are blooming perfume components and substantive perfume components. Blooming perfume components are defined by a boiling point less than 250° C. and a Log P greater than 2.5. Substantive perfume components are defined by a boiling point greater than 250° C. and a Log P greater than 2.5. Boiling point is measured at standard pressure (760 mm Hg). Preferably, a perfume composition will comprise a mixture of blooming and substantive perfume components. The perfume composition may comprise other perfume components.

It is commonplace for a plurality of perfume components to be present in a microcapsule. In the compositions for use in the present invention it is envisaged that there will be three or more, preferably four or more, more preferably five or more, most preferably six or more different perfume components in a microcapsule. An upper limit of 300 perfume components may be applied.

The microcapsules may comprise perfume components and a carrier for the perfume ingredients, such as zeolites or cyclodextrins.

Colourant

The particles of the present invention preferably comprise a colourant. The colourant may be a dye or a pigment or a mixture thereof. The colourant has the purpose to impart colour to the particles, it is not intended to be a shading dye or to impart colour to the laundered fabrics. A single colourant or a mixture of colourants may be used.

Preferably, the colourant is a dye, more preferably a polymeric dye. Non-limiting examples of suitable dyes include the LIQUITINET range of dyes ex Milliken Chemical.

Preferably the particles of the present invention comprise 0.001 to 2 w.t. %, more preferably 0.005 to 1 w.t. %, most preferably 0.01 to 0.6 w.t. %.

Additional Benefit Agents

The particles of the present invention comprise perfume as a primary benefit agent. However, it may be desirable for the particles of the present invention to deliver more than one benefit agent to laundered fabrics. Additional benefit agents may be free in the carrier material i.e. the PEG, or they may be encapsulated. Suitable encapsulating materials are outlined above in relation to perfumes.

a) malodour agents for example: uncomplexed cyclodextrin; odor blockers; reactive aldehydes; flavanoids; zeolites; activated carbon; and mixtures thereof
b) dye transfer inhibitors
c) shading dyes
d) silicone oils, resins, and modifications thereof such as linear and cyclic polydimethylsiloxanes, amino-modified, allcyl, aryl, and alkylaryl silicone oils, which preferably have a viscosity of greater than 50,000 cst;
e) insect repellents
f) organic sunscreen actives, for example, octylmethoxy cinnamate;
g) antimicrobial agents, for example, 2-hydroxy-4, 2,4-trichlorodiphenylether;
h) ester solvents; for example, isopropyl myristate;
i) lipids and lipid like substance, for example, cholesterol;
j) hydrocarbons such as paraffins, petrolatum, and mineral oil
k) fish and vegetable oils;
l) hydrophobic plant extracts;
m) waxes;
n) pigments including inorganic compounds with hydrophobically-modified surface and/or dispersed in an oil or a hydrophobic liquid, and;
o) sugar-esters, such as sucrose polyester (SPE).

Additional Ingredients

The particles of the present invention may comprises 0.1 to 10 w.t. % additional carrier material (in addition to the PEG). Examples of additional materials include clays, polysaccharides, glycerine, isopropyl myristate, dipropylene glycol, 1,2 propanediol, polypropylene glycol, PEG having an average molecular weight range of less than 2000 and mixtures thereof.

Laundry Actives

The particles of the present invention have the purpose of providing fragrance, the primary function is not softening or cleaning. The particles of the present invention are preferably substantially free of laundry and softening actives. By substantially free, it is meant 0 to 3 w.t. % of softening or cleaning actives, preferably 0 to 2 w.t. %, more preferably 0 to 1 w.t. % of the particle composition. Softening and cleaning agents are well known in the art, examples of which include: detergent surfactants, detergent builders, bleaching agents, enzymes, and quaternary ammonium compounds. A low level of non-detersive surfactant may be present in the perfume and/or benefit agent compositions which may be present in the particles of the present invention.

Form of Particles

The particles of the present invention may be in any solid form, for example: powder, pellet, tablet, prill, pastille or extrudate. Preferably the particles are in the form of a pastille. Pastilles can, for example, be produced using ROTOFORMER Granulation Systems ex. Sandvick Materials.

The particles may be any shape or size suitable for dissolution in the laundry process. Preferably, each individual particle has a mass of between 0.95 mg to 5 grams, more preferably 0.01 to 1 gram and most preferably 0.02 to 0.5 grams. Preferably each individual particle has a maximum linear dimension in any direction of 10 mm, more preferably 1-8 mm and most preferably a maximum linear dimension of 4-6 mm. The shape of the particles may be selected for example from spherical, hemispherical, compressed hemispherical, lentil shaped, oblong, or planar shapes such as petals. A preferred shape for the particles is hemispherical, i.e. a dome shaped wherein the height of the dome is less than the radius of the base. When the particles are compressed hemispherical, it is preferred that diameter of the substantially flat base provides the maximum linear dimension and the height of the particle is 1-5 mm, more preferably 2-3 mm. the dimensions of the particles of the present invention can be measured using Calipers.

The particles of the present invention can be formed from a melt comprising the ingredients, as outlined in the examples. The melt can, for example, be formed into particles by: Pastillation e.g. using a ROTOFORMER ex Sandvick Materials, extrusion, prilling, by using moulds, casting the melt and cutting to size or spraying the melt.

The particles of the present invention are preferably homogeneously structured. By homogeneous, it is meant that there is a continuous phase throughout the particle. There is not a core and shell type structure. Particles of dextrose and other materials such as perfume microcapsules will be distributed within the continuous phase.

Method of Use

The particles of the present invention are for use in the laundry process. They may be added in the wash phase, second phase or a rinse phase of a wash cycle using a washing machine. Alternatively the particles may be used in manual hand washing of fabrics. The particles may be used in addition to other laundry products or they may be used as a standalone product.

The particles of the present invention are preferably dosed in a quantity of 1 g to 50 g, more preferably 10 g to 45 g, most preferably 15 g to 40 g.

Use for the Particles

The primary use of the particles of the present invention is to impart fragrance to laundered fabrics. The fragrance is imparted during the laundry process. The particles may be further used to deliver additional benefit agents to fabrics during the laundry process.

EXAMPLES

Example 1

Compositions:

| | Comparative A | Example 1 |
|---|---|---|
| PEG 8000 [1] | 65 | 65 |
| Starch[2] | 26 | — |
| Anhydrous Dextrose[3] | — | 26 |
| Blue dye[4] | 0.0165 | 0.0145 |
| Free perfume | 7 | 6.35 |
| Perfume microcapsules[5] | 2 | 2.2 |

PEG 8000 [1] - Polyglycol 8000 ex Clariant
Starch[2]- Tapioca C*Creamgel 7001 ex Cargill
Anhydrous Dextrose[3]- C*Dex ex Cargill
Blue dye[4]- Milliken Liquitint Blue HP
Perfume microcapsules[5]- weight as supplied The slightly difference in levels of dye is to compensate for differences in the colour of Starch and Dextrose. This differences allows for an identical colour of freshly manufactured product and therefore ensures an accurate comparison.

Process of Manufacturing Pastilles:

The PEG was heated in a mixing vessel, with stirring, until molten and homogeneous. The starch or dextrose was then slowly added with stirring. Stirring was maintained during the addition of the fragrance, followed by the encapsulated fragrance and finally the dye was added. The mix was then pumped to a ROTOFORMER Model RF 4G ex Sandvick Materials and pastilled. The temperature of the melt material was 53-56° C. and belt temperature of 1-15° C. above local atmospheric dew point. The resulting pastilles were compressed hemispherical, having an average diameter of 4-6 mm.

The pastilles formed were hemispherical, had a largest diameter 4-6 mm and height 2-3 mm.

Observations:

| Description of colour | Comparative A | Example 1 |
|---|---|---|
| Fresh batch | Even distribution | Even distribution |
| 24 hours at ambient, stored open to the air | Uneven, a number of pastilles very pale on one side and dark on the other | Speckled - a few very small white spots |

The pastilles comprising dextrose were significantly more stable as demonstrated by lack of colour change.

Example 2

Compositions:

| | Comparative B | Example 2 |
|---|---|---|
| PEG 8000[1] | 65 | 65 |
| Dextrose Anhydrous[3] | 26.4 | — |
| Dextrose Monohydrate[6] | — | 26.4 |
| Dye[4] | 0.01 | 0.01 |
| Free Perfume | 6.35 | 6.35 |
| Perfume Microcapsules[5] | 2.2 | 2.2 |

PEG 8000[1]- Polyglycol 8000 ex Clariant
Anhydrous Dextrose[3]- C*Dex ex Cargill
Dextrose Monohydrate[6]- ex Cargill
Blue dye[4]- Milliken Liquitint Blue HP
Perfume microcapsules[5]- weight as supplied Process of Manufacturing Particles:

The PEG was heated in a mixing vessel, with stirring, until molten and homogeneous. The dextrose was then slowly added with stirring. Stirring was maintained during the addition of the fragrance, followed by the encapsulated fragrance and finally the dye was added. The melt was cast across the cold metal plate and allowed to solidify as a thin film of a few millimetres. This solid was then broken up into smaller pieces.

Observations:

Over the following days the physical properties of the products were monitored. Anhydrous dextrose (Example 2): Pieces of product continue to move freely Dextrose monohydrate (Comparative B): Became quite soft and crumbly, product unacceptable for consumer use.

The invention claimed is:

1. A composition comprising a plurality of particles, wherein said particles comprise: 40 to 95 wt. % polyethylene glycol, wherein the polyethylene glycol has a weight average molecular weight from 4000 to 12000; 0.1 to 50 wt. % saccharide of one to ten monosaccharide units, comprising anhydrous dextrose, and the saccharide is anhydrous; 0.1 to 30 wt. % perfume materials; and 0.001 to 2 wt. % colourant.

2. The composition according to claim 1, wherein the composition comprises 0.1 to 15 wt. % free perfume.

3. The composition according to claim 1, wherein the composition comprises 0.1 to 15 wt. % of perfume microcapsules.

4. The composition according to claim 1, wherein the perfume materials comprise both free perfume and perfume microcapsules.

5. The composition according to claim 3, wherein the perfume microcapsules comprise friable perfume microcapsules.

6. The composition according to claim 1, wherein the particles are pastilles.

7. The composition according to claim 1, wherein the particles have a maximum dimension of less than 10 mm.

8. The composition according to claim 1, wherein the particle is homogeneously structured.

9. A method for imparting fragrance to a laundered fabric, the method comprising: contacting the laundered fabric with a composition comprising particles, the particles comprising: 40 to 95 wt. % polyethylene glycol, wherein the polyethylene glycol has a weight average molecular weight from 4000 to 12000; 0.1 to 50 wt. % saccharide comprising one to ten monosaccharide units, comprising anhydrous dextrose, and the saccharide is anhydrous; 0.1 to 30 wt. % perfume materials; and 0.001 to 2 wt. % colourant.

* * * * *